US007395643B2

(12) United States Patent
Franchini et al.

(10) Patent No.: US 7,395,643 B2
(45) Date of Patent: Jul. 8, 2008

(54) METHOD OF MANUFACTURING RIGID CIGARETTE PACKS INCLUDING DEFORMING AT LEAST ONE LATERAL FACE OF THE WRAPPER

(75) Inventors: Alberto Franchini, Monteveglio (IT); Fiorenzo Draghetti, Medicina (IT)

(73) Assignee: G.D S.p.A., Bologna (IT)

( * ) Notice: Subject to any disclaimer, the term of this patent is extended or adjusted under 35 U.S.C. 154(b) by 186 days.

(21) Appl. No.: 10/450,092

(22) PCT Filed: Dec. 6, 2001

(86) PCT No.: PCT/IB01/02339

§ 371 (c)(1),
(2), (4) Date: Jun. 10, 2003

(87) PCT Pub. No.: WO02/48006

PCT Pub. Date: Jun. 20, 2002

(65) Prior Publication Data

US 2004/0035723 A1 Feb. 26, 2004

(30) Foreign Application Priority Data

Dec. 12, 2000 (IT) ..... BO2000A0722

(51) Int. Cl.
*B65B 61/24* (2006.01)

(52) U.S. Cl. ..... 53/436; 53/113; 53/523; 206/273; 229/160.1; 493/911

(58) Field of Classification Search ..... 53/436, 53/113, 523, 526, 122; 493/911; 206/273; 229/160.1; *B65B 61/24*
See application file for complete search history.

(56) References Cited

U.S. PATENT DOCUMENTS 2,176,912 A * 10/1939 Luckett ..... 206/273
3,272,320 A * 9/1966 Brungardt ..... 206/273
3,511,014 A * 5/1970 Kochalski ..... 53/436
3,857,223 A * 12/1974 Dominici ..... 53/526

(Continued)

FOREIGN PATENT DOCUMENTS

DE 19712937 A1 * 10/1998
EP 0930245 7/1999

*Primary Examiner*—Stephen F Gerrity
(74) *Attorney, Agent, or Firm*—Timothy J. Klima

(57) ABSTRACT

A rigid pack for tobacco products comprises an outer wrapper (3) furnished with a container (4) presenting an open top (5), surmounted by a lid (6) hinged to the container (4) and rotatable between a position in which the open top (5) is exposed and a position, interacting with a frame (20) anchored to the open top (5), in which the open top is closed, the tobacco products being enveloped by an inner wrapper (19). The pack (1) presents four lateral faces (16, 17, 18) arranged in two parallel pairs, also a top end face (15) and a bottom end face (11) disposed transversely to the lateral faces (16, 17, 18), which define a front, a back and two flanks. At least one of the lateral faces (16, 17, 18) presents a deformation referable to at least one bend line (21), coinciding with a crease line (3) impressed previously on the blank from which the pack is fashioned, and obtained by subjecting the flank faces (18) to compression in such a way that the bend line (21) is forced into relief.

10 Claims, 7 Drawing Sheets

U.S. PATENT DOCUMENTS 4,184,624 A 1/1980 MaGill
4,742,955 A * 5/1988 Focke et al. ..... 229/123
4,895,251 A 1/1990 Focke et al.
5,292,058 A * 3/1994 Zoss et al. ..... 206/273
5,782,063 A * 7/1998 Boriani et al. ..... 53/466
6,079,556 A * 6/2000 Draghetti et al. ..... 206/273

* cited by examiner

METHOD OF MANUFACTURING RIGID CIGARETTE PACKS INCLUDING DEFORMING AT LEAST ONE LATERAL FACE OF THE WRAPPER

This application is the National Phase of International Application PCT/IB01/02339 filed Dec. 6, 2001 which designated the U.S. and that International Application was published under PCT Article 21(2) in English.

TECHNICAL FIELD

The present invention relates to a pack of rigid type for tobacco products.

The term "pack" used throughout the following specification can be taken to mean either a packet designed to contain a group of cigarettes, or tobacco products broadly considered, or a carton able to accommodate a plurality of packets of cigarettes.

BACKGROUND ART

In general, a rigid pack of the type in question is fabricated from a precreased flat diecut blank and comprises a container, also a lid hinged to a rear edge of the selfsame container and rotatable thus about a hinge line between positions in which one open end of the container is open and closed, and a reinforcing frame disposed partly inside the container, anchored to the front and two flank faces, of which the function is typically to retain the lid correctly in the closed position.

Such packs comprise an outer wrapper fashioned from the aforementioned flat blank and containing a group of cigarettes enveloped by an inner wrapper made customarily of metal foil paper. The packer machines used currently to manufacture packets of cigarettes are designed to fold the outer wrapper closely about the inner wrapper, thus producing an packet of substantially rectangular parallelepiped shape which is rendered extremely compact, with the result that any relative movement between the outer and inner wrappers and the cigarettes of the group is prevented. Conversely, this packaging solution betrays the drawback that the smoker, having opened the packet, has difficulty in removing the first few cigarettes of the group.

Moreover, once the hinged lid has been opened for the first time and removed thus from a position in which its edges were faultlessly aligned and in contact with the corresponding edges afforded by the open end of the container, it is difficult for this position to be regained when the lid is closed again, and the edges of the container and the lid remain distanced marginally from one another.

The object of the present invention is to overcome the drawbacks described above.

DISCLOSURE OF THE INVENTION

The stated object is realized according to the present invention in a pack of rigid type for tobacco products, comprising a wrapper which in turn comprises a container with an opening at the top, a lid serving to open and close the opening, and an inner wrapper enveloping a group of tobacco products, wherein the pack presents a plurality of lateral faces, a top end face and a bottom end face, characterized in that at least one face of the wrapper presents a deformation defined by at least one bend line generated on the selfsame face.

The present invention relates also to a method of manufacturing packs of rigid type for tobacco products.

The stated object is realized according to the invention in a method by which to manufacture packs of rigid type for tobacco products, comprising a wrapper that consists in a container with an opening, a lid serving to open and close the opening, and an inner wrapper enveloping a group of tobacco products, wherein the pack presents a plurality of lateral faces, a top end face and a bottom end face, characterized in that it comprises the steps of advancing the packs along the outfeed line of a packer machine, subjecting the pack to a force of compression applied by way of at least two opposite lateral faces in such a manner as to induce a deformation on at least one of the lateral faces of the wrapper lying transversely to the faces subjected to the compression, defined by at least one bend line coinciding with a crease line impressed on the selfsame face.

The invention will now be described in detail, by way of example, with the aid of the accompanying drawings, in which.

Figure 6:
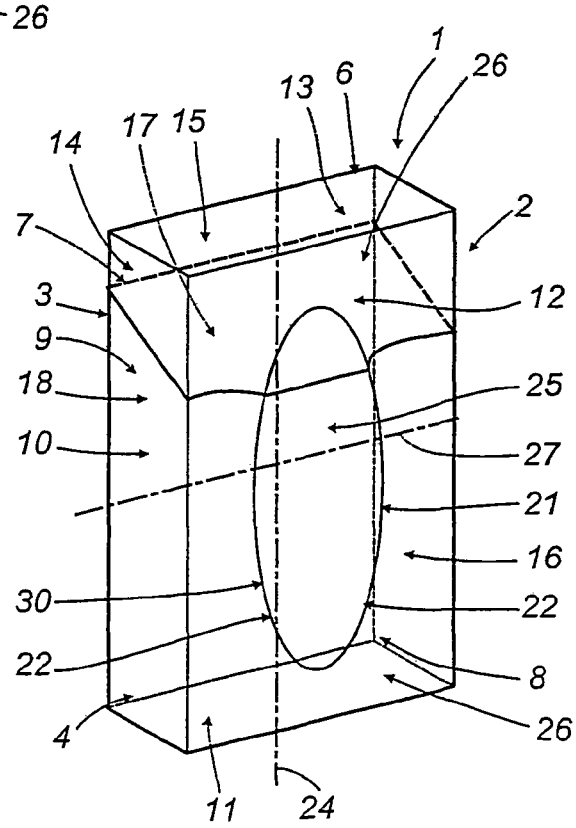
Figure 7:
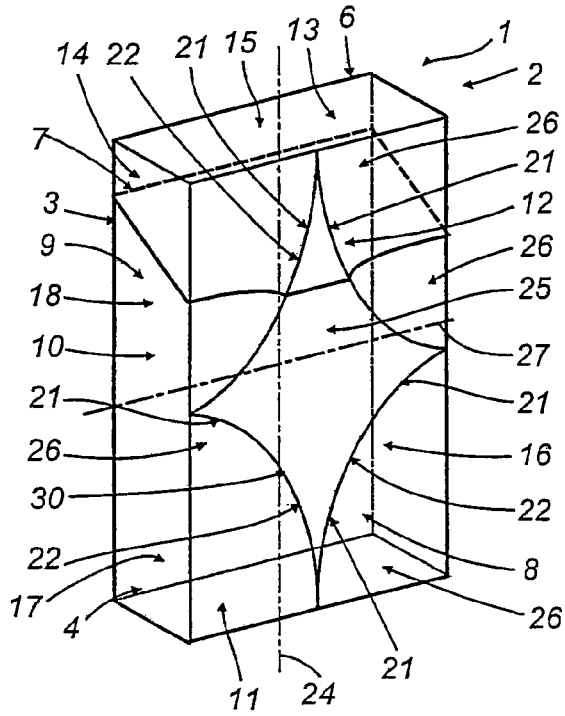
Figure 8:
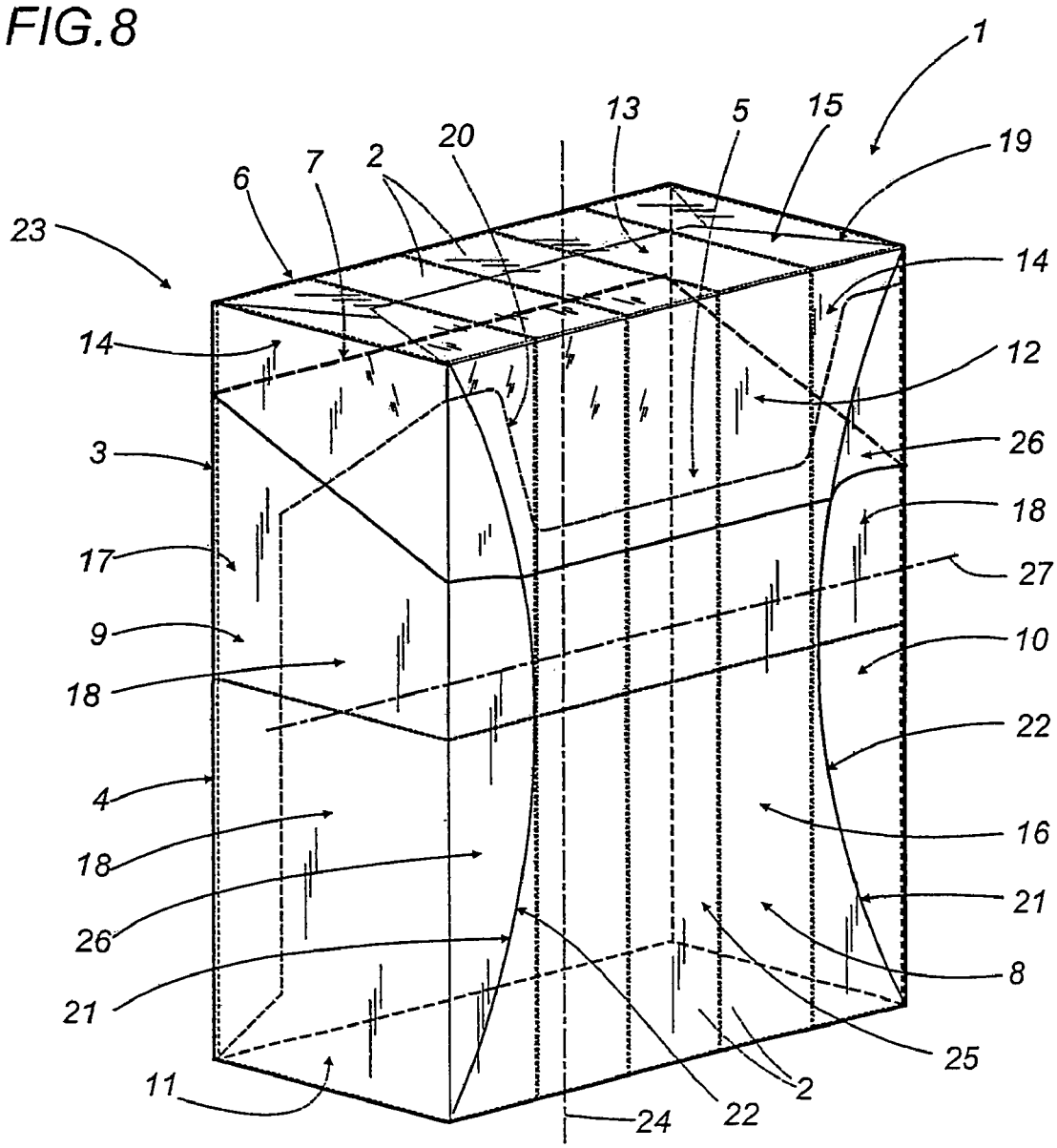
FIG. 8 illustrates a pack embodied in accordance with the invention, in particular a carton designed to contain a plurality of packet of cigarettes, viewed schematically and in perspective.

With reference to FIGS. 1 to 7 of the drawings, 1 denotes a rigid pack for tobacco products, in its entirety, embodied as a rigid packet 2 serving to contain a group 2 of cigarettes (not illustrated), whereas in FIG. 8 the pack is a carton 23 serving to contain a plurality of packets 2. The pack 1 appears substantially parallelepiped in shape and comprises an outer wrapper 3 comprising in its turn a cupped container 4 with an open top end 5; the container 4 is surmounted by a lid 6 also of cupped embodiment, hinged to the container along a crease line 7 and rotatable thus between a position in which the top end 5 is exposed (not illustrated) and a position in which the selfsame end 5 is concealed.

The container 4 presents a front 8, a back 9, two flanks 10, and a bottom 11; the lid 6 similarly presents a front 12, a back 13, two flanks 14, and a top 15.

The front 8, the back 9 and the flanks 10 of the container 4 and the front 12, back 13 and flanks 14 of the lid 6 combine respectively to form lateral faces of which the front face is denoted 16, the rear face is denoted 17 and the flank faces are denoted 18, these combining with the bottom 11 of the container 4 and the top 15 of the lid 6 to establish the outer wrapper 3 of the pack 1.

Figure 1:
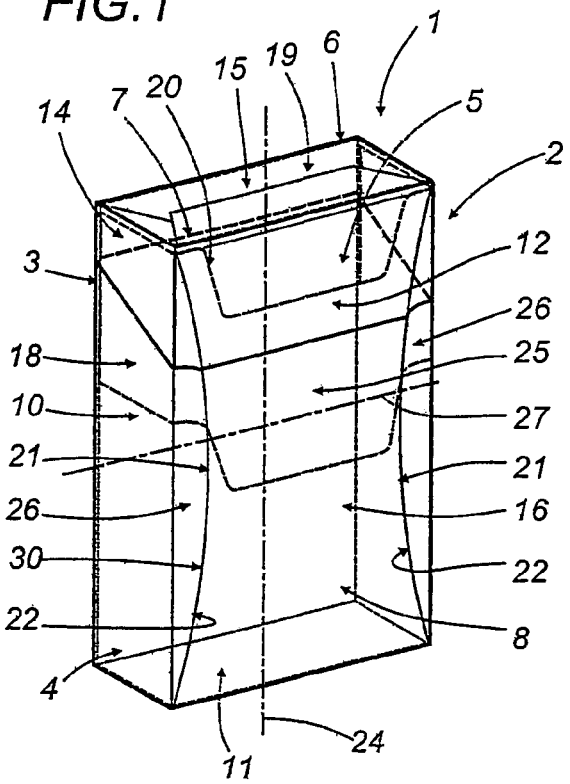
FIGS. 1 and 2 illustrate a pack embodied in accordance with the invention, in particular a packet of cigarettes, viewed schematically and in perspective.
Figure 2:
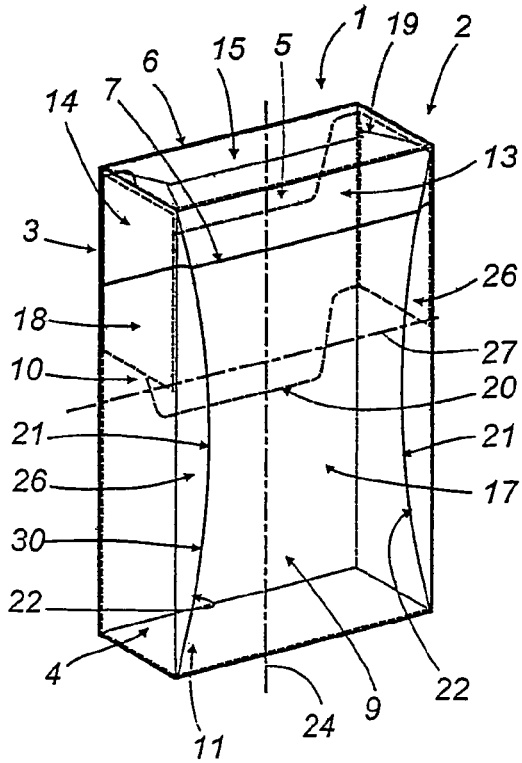

As illustrated specifically in FIGS. 1 and 2, the packet 2 accommodates an inner wrapper 19 enveloping the aforementioned group of cigarettes, and is furnished with a reinforcing frame 20 interposed between the outer wrapper 3 and the inner wrapper 19, anchored to the container 4 and projecting in part from the open top end 5 of the selfsame container to provide a stabilizing element for the lid 6 when in the closed position.

In the examples of FIGS. 1 to 7, at least one of the four lateral faces presented by the outer wrapper 3 of the packet 2 exhibits a deformation referable to at least one bend line 21 that causes the selfsame face to bulge, thereby reducing the rigidity of the packet 2 and facilitating the removal of the cigarettes.

In its simplest form, the bend line 21 defines and coincides with an edge 22 by which the lateral face of the outer wrapper 3 of the packet 2 that presents the deformation is divided into at least two portions, and, since the edge 22 is directed away from the packet 2 and therefore detached marginally from the corresponding breasted face of the inner wrapper 19, the two portions of the face in question will appear partially and progressively detached from the face of the inner wrapper 19 by a distance increasing from a minimum, at the corner edges along which they are in contact with the inner wrapper 19, to a maximum at the edge 22 along which the gap separating them from the wrapper 19 is greatest. Besides reducing the rigidity of the packet 2 as already intimated, this expedient also lends a faceted aspect to the face of the packet 2 and permits thus of creating chiaroscuro effects which, when special types of surface finish are applied to the relative flat diecut blank used to fashion the packet 2, such as metallization and the like, serve to enhance the varied reflection of light from the packet 2.

In the embodiment of FIGS. 1 and 2, the front face 16 and the rear face 17 presented by the outer wrapper 3 of the packet 2 each exhibit two bend lines 21 disposed symmetrically in relation to a longitudinal axis 24 of the pack 1; in particular, the two bend lines 21 are of arcuate outline and extend between the two opposite transverse edges of the respective faces 16 and 17, that is to say the edges along which these same faces 16 and 17 are joined to the top end face 15 and the bottom end face 11 of the pack. In this example, each face 16 and 17 is divided by the edges 22 generated along the bend lines 21 into three portions, identifiable as a bulging central portion 25, and two lateral portions 26 each compassed between a relative bend line 21 and the corresponding longitudinal edge of the packet 2.

Figure 3:
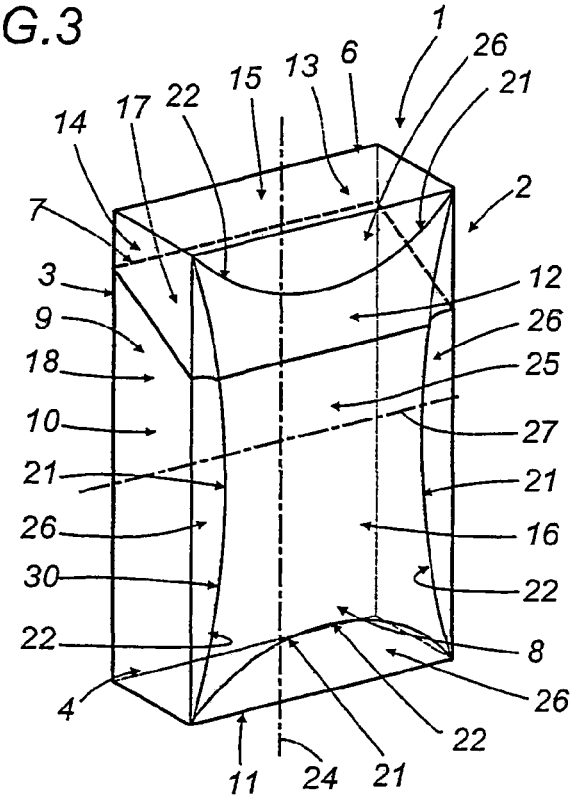
FIGS. 3 to 7 illustrate four further embodiments of the pack of FIG. 1, viewed schematically and in perspective.

In the example of FIG. 3, the front and rear faces 16 and 17 of the outer wrapper 3 each present four bend lines 21, of which two are disposed as illustrated in FIGS. 1 and 2 and two disposed symmetrically in relation to a transverse axis 27 of the pack 1. In particular, the bend lines 21 placed symmetrically in relation to the transverse axis 27 are of arcuate outline and extend between the two opposite longitudinal edges of the relative faces 16 and 17, that is to say the edges along which these same faces 16 and 17 are joined to the flank faces 18. In this example there are four lateral portions 26 and the central portion 25 is compassed entirely by the four bend lines 21.

Figure 4:
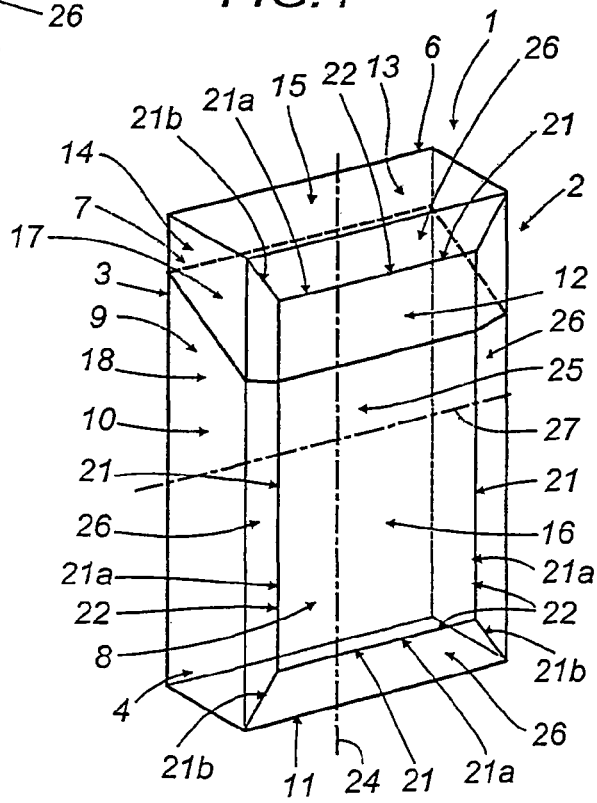

Likewise in the example of FIG. 4, the bend lines 21 are four in number but in this instance of angular outline, and more exactly, each composed of a straight leg 21*a* joined to two angled legs 21*b* extending from the opposite ends of the straight leg 21*a* and terminating at respective corners of the face 16 and 17. In the particular example illustrated, the central portion 25 of each face 16 and 17 is substantially flat and rectangular, and completely detached from the corresponding face of the inner wrapper 19.

Figure 5:
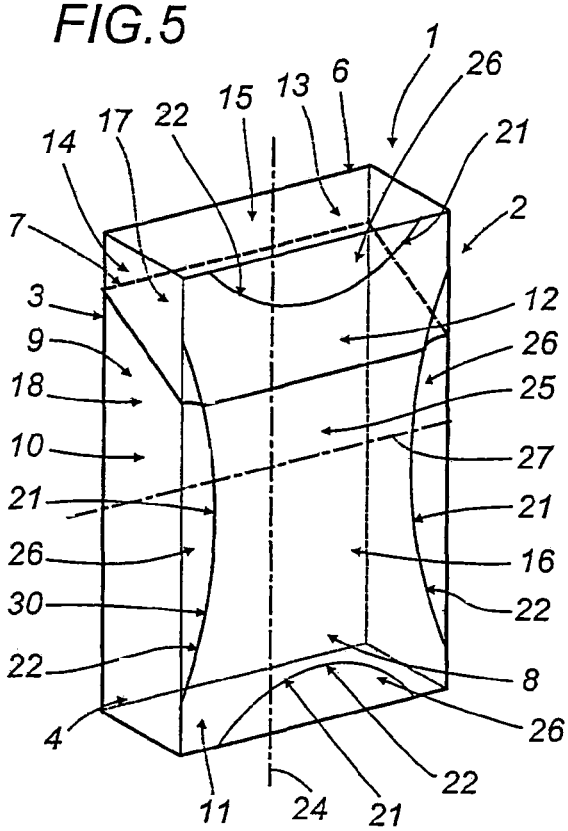

In the example of FIG. 5, the front and rear faces 16 and 17 both present four bend lines 21 of arcuate outline, each subtended by one respective edge of the face, and more exactly, two disposed symmetrically on either side of the longitudinal axis 24 of the pack, subtended each by a relative longitudinal edges, and two disposed symmetrically on either side of the transverse axis 27, subtended each by a relative transverse edge.

The example of FIG. 6 illustrates a single bend line 21 describing a closed outline of elliptical geometry, whilst in the example of FIG. 7 both faces 16 and 17 present four bend lines 21, each placed with the respective ends terminating on two adjoining edges of the relative faces 16 and 17.

It will be observed that in FIG. 6, as in the example of FIG. 4, the central portion 25 of each face 16 and 17 is completely detached from the corresponding face of the inner wrapper 19.

Figure 9:
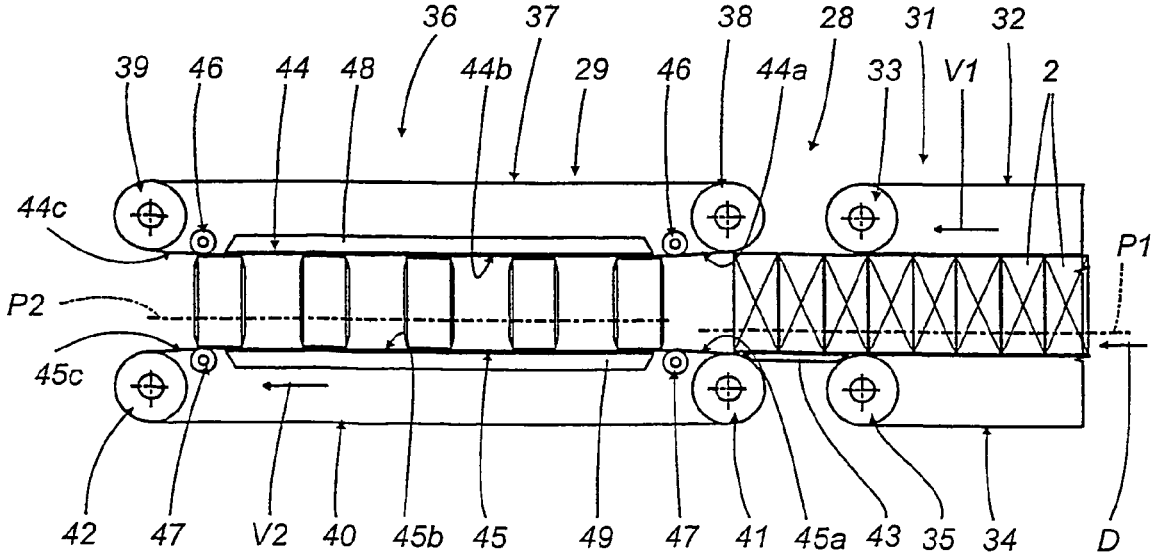
FIG. 9 illustrates a device used to manufacture packs as in FIGS. 1 to 8, viewed schematically in a front elevation and with certain parts omitted for clarity.
Figure 10:
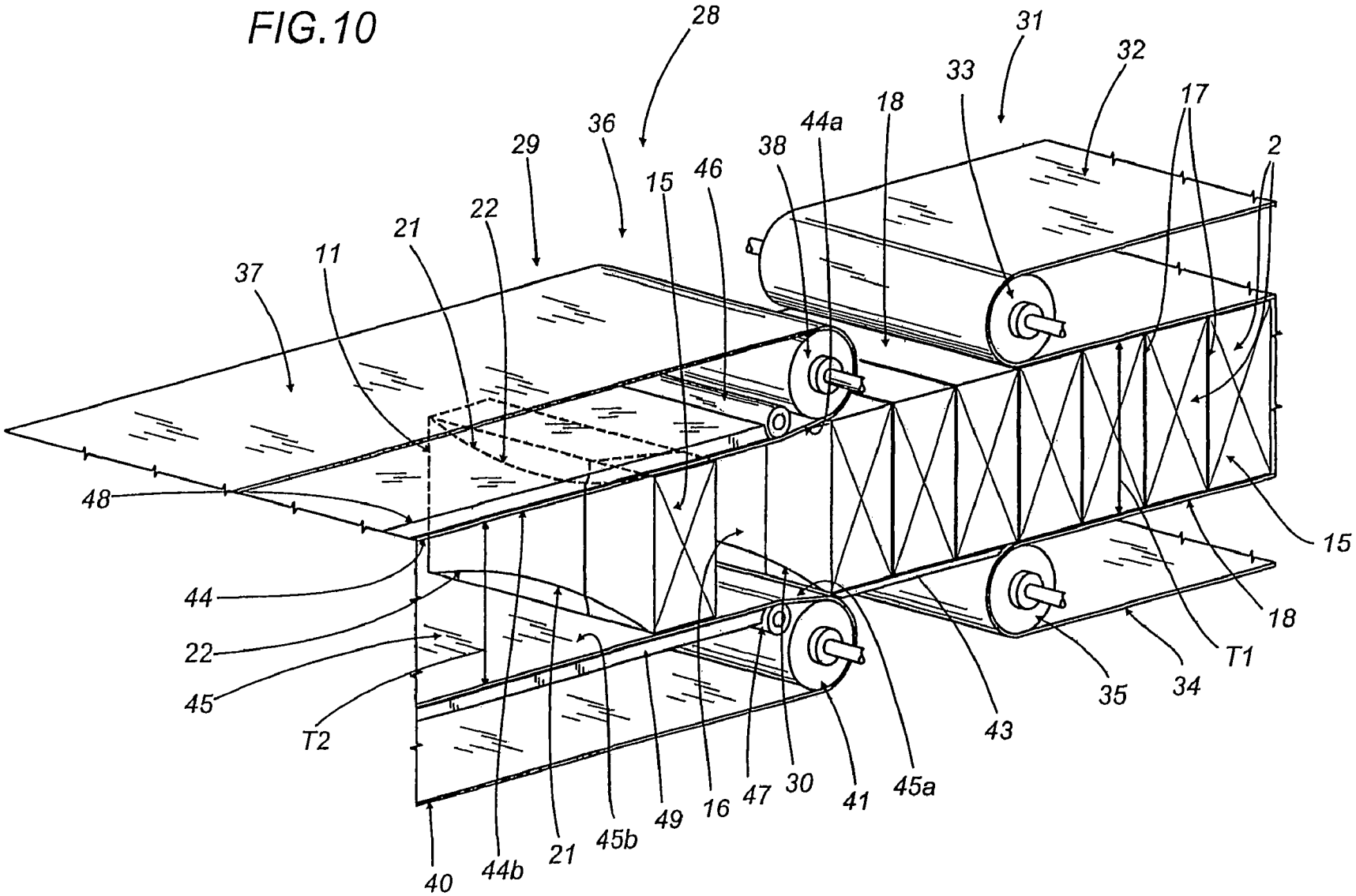
FIG. 10 illustrates a detail of the device of FIG. 9 for manufacturing packs as in FIGS. 1, 2 and 6, viewed schematically and in perspective with certain parts omitted.
Figure 11:
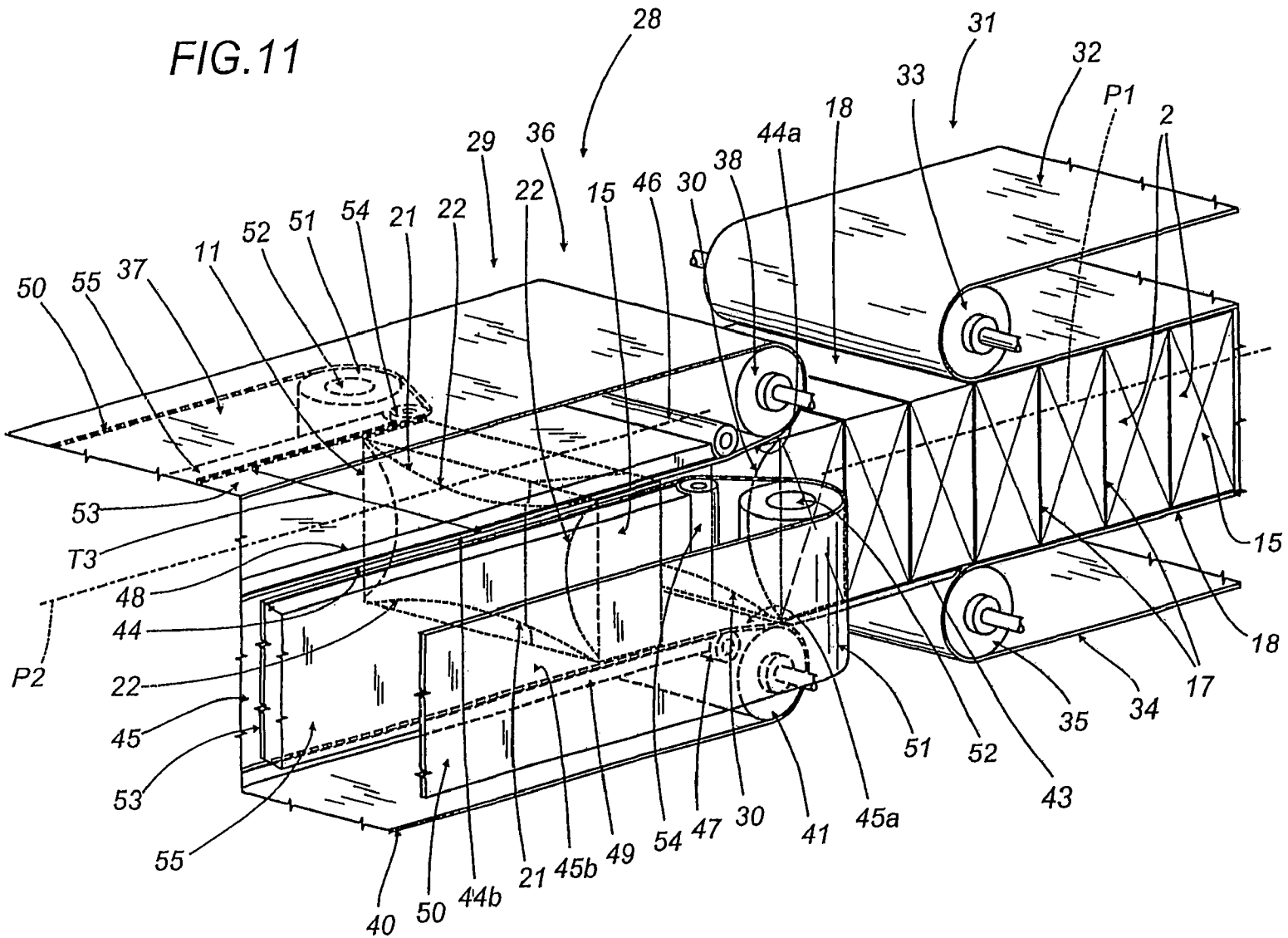
FIG. 11 illustrates an alternative embodiment of the device of FIG. 9 for manufacturing packs as in FIGS. 3, 4, 5 and 7, viewed schematically and in perspective with certain parts omitted for clarity.

With reference now to FIGS. 9, 10 and 11, the packs illustrated in FIGS. 1 to 8 are obtained by causing the single packets 2 emerging from a packer machine (not illustrated) to advance along an outfeed line, denoted 28 in its entirety and comprising a deformation device 29 by which at least two of the aforementioned opposite lateral faces 16 and 17 or 18 are subjected to compression in such a way that at least one of the selfsame lateral faces 16 and 17 of each outer wrapper 3 adjoining the faces subjected to the compressive force will undergo a plastic deformation referable to at least one bend line 21 coinciding with a crease line 30, applied to the selfsame face prior to the compression step.

Whilst it will be evident that the same method of deformation can be used for cartons 23, reference is made in the following description to packets 2 only, for the sake of simplicity.

Referring to FIGS. 9 and 10, the aforementioned outfeed line 28 includes a conveyor 31 that serves to stabilize the advancing packets 2 of cigarettes, consisting in a top belt 32 looped around two respective end pulleys 33 (one only illustrated in the drawings) of which one is power driven, and a bottom belt 34 likewise looped around two end pulleys 35 (one only illustrated in the drawings) of which one is power driven for example employing a transmission of conventional type, not indicated, by way of which it is coupled mechanically to the pulley 33 of the top belt 32.

The two belts 32 and 34 present a transverse dimension substantially equal to the longitudinal dimension of the single packet 2, and are arranged with their active branches mutually opposed and set apart by a distance T1 substantially equal to the transverse dimension of the packet 2. The active branches are designed to engage the flank faces 18 of the packets 2 as these advance, breasted in contact one with the next by way of the larger lateral faces 16 and 17, proceeding along a first stabilization path P1 in a conveying direction D normal to the selfsame faces 16 and 17 at a first predetermined velocity V1.

The deformation device 29, positioned downstream of the stabilization conveyor 31, comprises a deforming and spacing conveyor 36 that consists in a top belt 37 looped around two end pulleys 38 and 39 of which at least one, located downstream as viewed in FIG. 9 and denoted 39, is power driven independently of the power driven pulley 33 of the stabilization conveyor 31, and a bottom belt 40 looped similarly around two end pulleys 41 and 42 of which at least one, located downstream as viewed in FIG. 9 and denoted 42, is rotatable about an axis disposed parallel to that of the pulley 39 above, and power driven for example employing a transmission of conventional type, not indicated, by way of which it is coupled mechanically to the selfsame pulley 39.

The two belts 37 and 40 present a transverse dimension substantially equal to the longitudinal dimension of the single packet 2 and are arranged with their active branches mutually opposed in such a manner as to engage the flank faces 18 of the packets 2 and cause them to advance along a second path P2 in the conveying direction D at a second predetermined velocity V2 greater than the first velocity V1, with the result that the packets 2 proceed along the second path P2 spaced apart one from the next by a predetermined distance. A fixed bridge 43 positioned between the top branches of the bottom belts 34 and 40 provides a connecting element along which the packets 2 are able to pass from the stabilization conveyor 31 to the deforming and spacing conveyor 36.

In particular, the bottom branch 44 of the top belt 37 and the top branch 45 of the bottom belt 40 of the conveyor 36, extending in mutual opposition on either side of the second path P2, are routed over respective diverter rollers, and more exactly over a pair of rollers denoted 46 associated with the bottom branch 44 of the top belt 37 and a pair of rollers 47 associated with the top branch 45 of the bottom belt 40.

The top rollers 46 are positioned near to the pulleys 38 and 39 of the top belt, disposed with their respective axes of rotation parallel to but offset from those of the two pulleys 38 and 39, and in like manner, the bottom rollers 47 are disposed with respective axes of rotation parallel to but offset from those of the bottom pulleys 41 and 42. In particular, the top rollers 46 are offset toward the bottom belt 40 and the bottom rollers 47 are offset toward the top belt 37, in such a way that the mutually opposed branches 44 and 45 are set apart by a distance T2 less than the distance T1 first mentioned and consequently less than the transverse dimension of the single packet 2.

Thus, proceeding from the upstream pulley 38 along the conveying direction D, the branch 44 of the top belt presents a first leg 44*a* angled downwardly and toward the opposite branch 45, a second rectilinear leg 44*b*, and a third leg 44*c* angled upwardly, away from the opposite branch 45 and toward the downstream pulley 39. Similarly, proceeding from the upstream pulley 41 along the conveying direction D, the branch 45 of the bottom belt presents a first leg 45*a* angled upwardly and toward the opposite branch 44, a second rectilinear leg 45*b*, and a third leg 45*c* angled downwardly, away from the opposite branch 44 and toward the downstream pulley 42. Also forming part of the conveyor 36 are a rectilinear restraint 48 located between the top rollers 46 and a rectilinear restraint 49 located between the bottom rollers 47, along which the rectilinear legs 44*b* and 45*b* of the respective branches 44 and 45 are caused to slide substantially in breasted contact.

In operation, the packets 2 running out of the upstream conveyor 31 arrive at the entry point of the downstream conveyor 36 and are taken up between the angled legs 44*a* and 45*a* offered by the active branches 44 and 45 of the two belts 37 and 40, whereupon the two flank faces 18 of each packet 2 are subjected gradually to a force of compression, first by the rollers 46 and 47 and thereafter by the restraints 48 and 49, in such a way that the crease lines 30 yield and thus generate the bend lines 21 along which the front and rear faces 16 and 17 are caused to deform plastically in the intended manner, for example as illustrated in FIGS. 1, 2, 6 and 8.

The solution illustrated in FIG. 11 differs from that of FIGS. 9 and 10 simply in that the deforming and spacing conveyor 36 comprises two further belts 50 positioned laterally on opposite sides of the second path P2, extending mutually parallel and disposed with their active branches engaging the top end faces 15 and the bottom end faces 11 of the packets 2 as these are spaced apart one from the next and caused to advance along the conveying direction D, with which the selfsame top and bottom end faces 15 and 11 are parallel.

In like manner to the belts 37 and 40 already described, each lateral belt 50 is looped around two respective pulleys 51 of which FIG. 11 shows only the two positioned upstream relative to the direction D followed by the packets 2, near the runout of the stabilization conveyor 31. In this instance the pulleys 51 are mounted to respective shafts 52 with vertically disposed axes The mutually opposed active branches 53 of the lateral belts, directed toward the middle of the conveyor 36, present respective pairs of diverter rollers 54 positioned near the pulleys 51 and disposed with their axes of rotation parallel to but offset from those of the selfsame pulleys 51. In particular, the rollers are offset toward the middle of the conveyor 36 in such a way that the mutually opposed branches 53 are set apart by a distance T3 less than the longitudinal dimension of the single packet 2. Thus, departing from the pulley 51 nearer the runout of the stabilization conveyor 31 and proceeding along the conveying direction D, each active branch 53 presents a first leg 53*a* angled inwardly toward the middle of the conveyor 36, a second rectilinear leg 53*b*, and a third leg (not illustrated) angled outwardly and away from the middle of the conveyor 36. Each lateral belt 50 further comprises a rectilinear restraint 55 extending between the relative pair of rollers 54, along which the respective rectilinear leg 53*b* of the active branch 53 is caused to slide substantially in breasted contact.

In this particular instance the top and bottom belts 37 and 40 will perform the same operation of compressing the two flank faces 18 of the packet 2, as described with reference to FIGS. 9 and 10, whereas on encountering the lateral belts 50, each packet 2 will be subjected gradually to a force of compression applied to the top end face 15 and the bottom end face 11, first by the rollers 54 and thereafter by the restraints 55, in combination with the force of compression applied by the other belts 37 and 40, in such a way that the crease lines 30 yield and generate the bend lines 21 along which the front and rear faces 16 and 17 are caused to deform plastically, for example as illustrated in FIGS. 3, 4, 5 and 7.

The invention claimed is:

1. A method of manufacturing packs of rigid type for tobacco products, comprising a wrapper that comprises a container with an opening, a lid serving to open and close the opening, and an inner wrapper enveloping a group of tobacco products, wherein the pack includes a plurality of lateral faces, a top end face and a bottom end face, the method comprising the steps of advancing the packs along an outfeed line of a packer machine, and plastically deforming at least one of the lateral faces of the wrapper along a crease line impressed thereon by subjecting the pack to a force of compression applied to at least two opposite faces of the wrapper lying transversely to the face to be plastically deformed.

2. A method as in claim 1, wherein the opposite faces subjected to compression are two flank faces of the pack, and the compression step serves to generate two bend lines disposed symmetrically in relation to a longitudinal axis of the pack.

3. A method as in claim 1, wherein the faces subjected to compression are the top end face and the bottom end face, and the compression step serves to generate two bend lines on the lateral face disposed symmetrically in relation to a transverse axis of the pack.

4. A method as in claim 1, wherein the faces subjected to compression are two flank faces, the top end face and the bottom end face of the pack in such a way as to generate four bend lines on the lateral face arranged in pairs and symmetrically disposed.

5. A method as in claim 4, wherein the bend lines define a central portion of the face that is detached from the corresponding face of the inner wrapper.

6. A method as in claim 1, wherein the wrapper is of substantially parallelepiped appearance and comprises a container of cupped embodiment that presents an opening at the top, also a lid of cupped embodiment hinged to the container and rotatable thus between a position in which the opening is exposed and a position of interaction with a frame occupying the opening, in which the opening is concealed.

7. A method as in claim 1, wherein the at least one lateral face is plastically deformed while on the outfeed line.

8. A method of manufacturing packs of rigid type for tobacco products, comprising a wrapper that comprises a container with an opening, a lid serving to open and close the opening, and an inner wrapper enveloping a group of tobacco products, wherein the pack includes a plurality of lateral faces, a top end face and a bottom end face, the method comprising the step of deforming at least one of the lateral faces of the wrapper along a crease line impressed thereon by subjecting the pack to a force of compression applied to two flank faces, the top end face and the bottom end face of the pack for generating four bend lines on the lateral face arranged in pairs and symmetrically disposed.

9. A method as in claim 8, wherein the bend lines define a central portion of the face that is detached from the corresponding face of the inner wrapper.

10. A method as in claim 9, wherein the at least one lateral face is plastically deformed while on the outfeed line.

* * * * *